US012570453B2

(12) United States Patent
Sakonuma et al.

(10) Patent No.: US 12,570,453 B2
(45) Date of Patent: Mar. 10, 2026

(54) PACKAGING BAG, SEALING BAR, AND PRODUCTION METHOD FOR PACKAGING BAG

(71) Applicant: KYORAKU CO., LTD., Kyoto (JP)

(72) Inventors: Hirofumi Sakonuma, Bangkok (TH); Supparak Uraivorn, Amphur Pluakdaeng (TH)

(73) Assignee: KYORAKU CO., LTD., Kyoto (JP)

( * ) Notice: Subject to any disclaimer, the term of this patent is extended or adjusted under 35 U.S.C. 154(b) by 165 days.

(21) Appl. No.: 18/263,411

(22) PCT Filed: Jan. 25, 2022

(86) PCT No.: PCT/JP2022/002545

§ 371 (c)(1),
(2) Date: Jul. 28, 2023

(87) PCT Pub. No.: WO2022/163608

PCT Pub. Date: Aug. 4, 2022

(65) Prior Publication Data

US 2024/0308749 A1 Sep. 19, 2024

(30) Foreign Application Priority Data

Jan. 28, 2021 (JP) ..... 2021-012408
May 31, 2021 (JP) ..... 2021-091746

(51) Int. Cl.
*B65D 77/22* (2006.01)
*B65B 7/02* (2006.01)
*B65D 75/30* (2006.01)

(52) U.S. Cl.
CPC ..... *B65D 77/225* (2013.01); *B65B 7/025* (2013.01); *B65D 75/30* (2013.01); *B65D 2205/025* (2013.01)

(58) Field of Classification Search
CPC ..... B65B 7/025; B65D 77/225; B65D 33/01; B65D 81/34; B65D 81/3461; B65D 75/5855
(Continued)

(56) References Cited

U.S. PATENT DOCUMENTS

2007/0261974 A1* 11/2007 Balteau ..... B29C 66/244 206/219
2008/0240628 A1* 10/2008 VanLoocke ..... B65D 75/5833 383/210

FOREIGN PATENT DOCUMENTS

JP H09290871 A 11/1997
JP 2007238165 A 9/2007
(Continued)

OTHER PUBLICATIONS

Miyashita (Year: 2007).*
(Continued)

*Primary Examiner* — Nathan J Newhouse
*Assistant Examiner* — Nina K Attel
(74) *Attorney, Agent, or Firm* — Maier & Maier, PLLC

(57) ABSTRACT

The present invention provides a packaging bag that can suppress the formation of an opening at a portion other than the vapor release seal portion. According to the present invention, provided is a packaging bag made of a film heat-sealed at a seal portion, wherein the seal portion includes a vapor release seal portion configured to form a vapor flow path as an internal pressure increases, the vapor release seal portion has a curved shape curved toward an inner direction of the packaging bag, the vapor release seal portion includes a first region including a distal end of the curved shape and a second region adjacent to the first region, and sealing strength in the first region is higher than sealing strength in the second region.

6 Claims, 7 Drawing Sheets

(58) Field of Classification Search
USPC ..... 383/210.1, 210–211, 100, 101, 103
See application file for complete search history.

(56) References Cited

FOREIGN PATENT DOCUMENTS

| | | | |
|---|---|---|---|
| JP | 2013163546 | A | 8/2013 |
| JP | 2016188091 | A | 11/2016 |
| JP | 3212645 | U | 9/2017 |
| JP | 2017165480 | A | 9/2017 |
| JP | 2019034763 | A | 3/2019 |
| WO | 2013100058 | A1 | 7/2013 |

OTHER PUBLICATIONS

Morita (Year: 2017).*
Shimono (Year: 2019).*
International Search Report issued on Mar. 15, 2022, in corresponding International Application No. PCT/JP2022/002545; 4 pages.

* cited by examiner

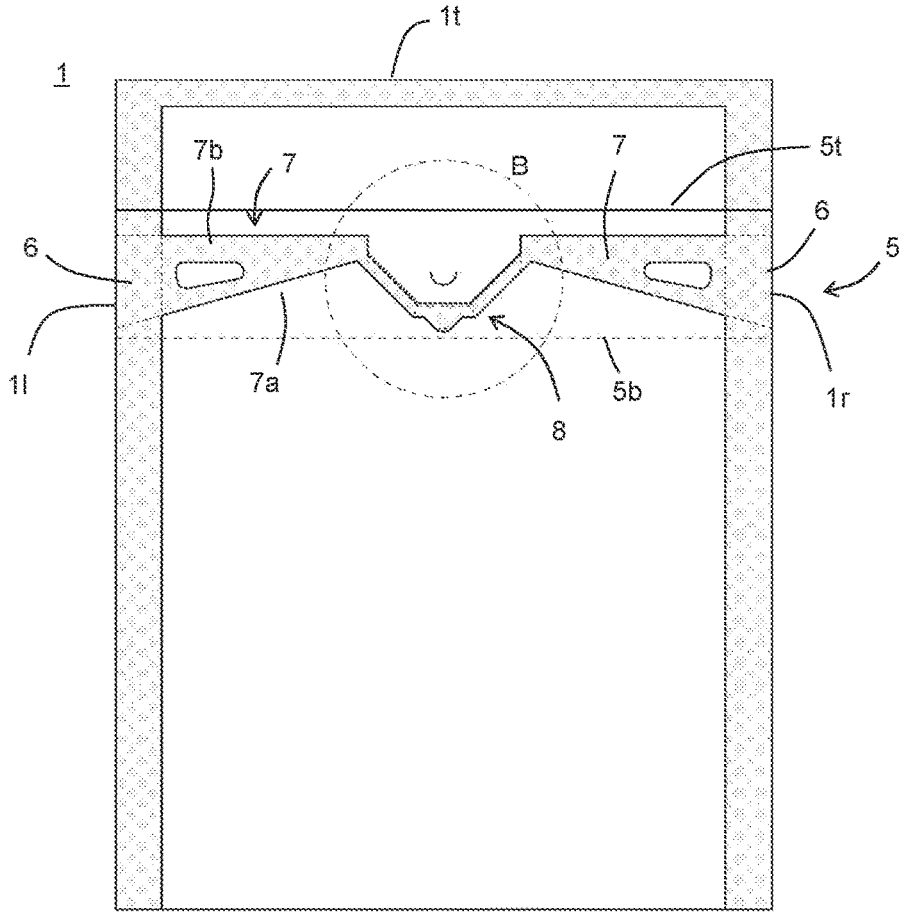
Fig. 6A
Fig. 6B
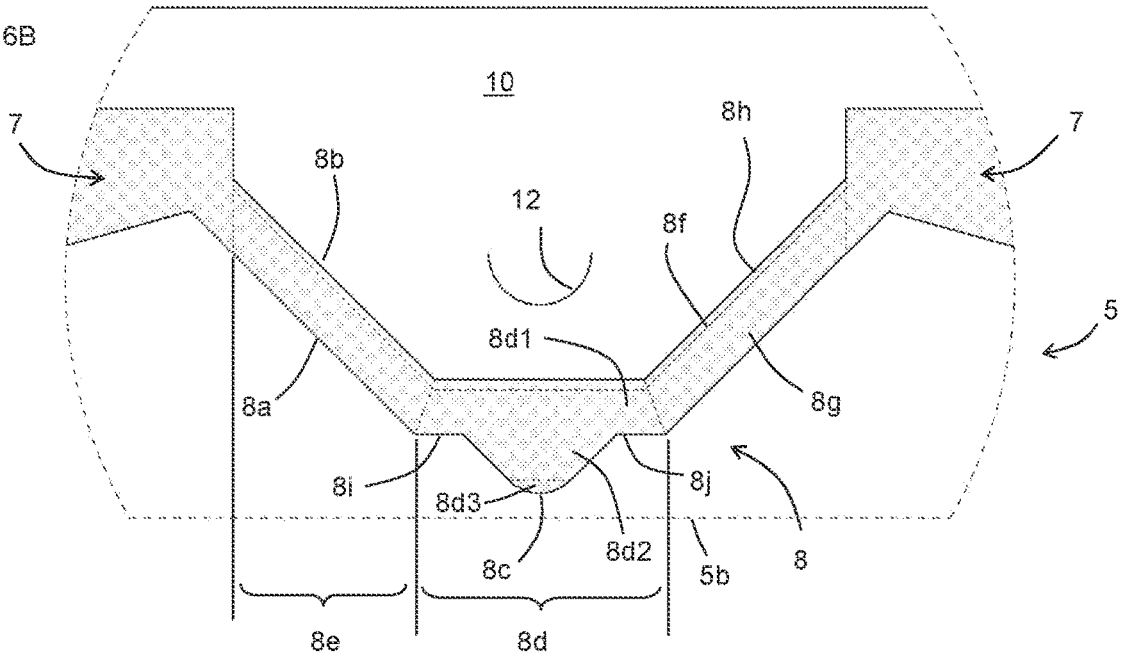

PACKAGING BAG, SEALING BAR, AND PRODUCTION METHOD FOR PACKAGING BAG

TECHNICAL FIELD

The present invention relates to a packaging bag suitable for heating contents in a microwave oven.

BACKGROUND ART

Patent Literature 1 discloses a packaging bag configured by heat-sealing a flexible film at a seal portion. This packaging bag is provided with a vapor release seal portion to release vapor generated when the contents are heated in a microwave oven.

CITATION LIST

Patent Literature

Patent Literature 1: WO2013/100058A1

SUMMARY OF INVENTION

Technical Problem

In Patent Literature 1, the vapor release seal portion has a curved shape that is curved toward the inner direction of the packaging bag. As the internal pressure of the packaging bag increases, the distal end of the curved shape peels off to form an opening, and vapor is discharged through this opening. To quickly discharge the vapor in the packaging bag, it is ideal that the peeling that has started at the distal end of the curved shape quickly progresses to a portion other than the distal end to expand the opening, but there are cases in which the peeling does not progress quickly. If the peeling does not progress quickly, the internal pressure of the packaging bag may become too high, for example, in the case of rapid heating, and an opening may be formed at a portion other than the vapor release seal portion, and vapor may be discharged from the opening.

The present invention has been made in view of such circumstances and provides a packaging bag that can suppress the formation of an opening at a portion other than the vapor release seal portion.

Solution to Problem

According to the present invention, provided is a packaging bag made of a film heat-sealed at a seal portion, wherein the seal portion comprises a vapor release seal portion configured to form a vapor flow path as an internal pressure increases, the vapor release seal portion has a curved shape curved toward an inner direction of the packaging bag, the vapor release seal portion includes a first region including a distal end of the curved shape and a second region adjacent to the first region, and sealing strength in the first region is higher than sealing strength in the second region.

In the packaging bag of the present invention, the sealing strength of the first region that constitutes the vapor release seal portion and includes the distal end of the curved shape is higher than the sealing strength of the second region adjacent to the first region. Thus, when the peeling starts in the first region, the peeling progresses quickly in the second region. Therefore, the opening formed in the vapor release seal portion expands quickly, and thus the formation of an opening at a portion other than the vapor release seal portion is suppressed.

Hereinafter, various embodiments of the present invention will be exemplified. The embodiments shown below can be combined with each other.

Preferably, the packaging bag comprises a front surface portion having a lower front surface portion and an upper front surface portion, at a joint portion where an inner surface of the lower front surface portion and an inner surface of the upper front surface portion are partially overlapped, the lower front surface portion and the upper front surface portion are heat-sealed at a pair of side seal portions, a pair of end seal portions, and the vapor release seal portion, the side seal portions are provided along side edges of the joint portion and are connected to the vapor release seal portion via the end seal portions, and sealing strength at the end seal portions is higher than the sealing strength in the first region.

Preferably, the vapor release seal portion comprises an inner region and an outer region configured by dividing the vapor release seal portion at a boundary line located between an inner edge and an outer edge of the vapor release seal portion, and the inner region and the outer region differ from each other in sealing strength.

Preferably, provided is a seal bar used for manufacturing the above-described packaging bag, comprising: a vapor release seal forming portion for forming the vapor release seal portion, wherein the vapor release seal forming portion comprises a first region forming portion for forming the first region and a second region forming portion for forming the second region, and a protrusion amount of the first region forming portion is larger than a protrusion amount of the second region forming portion.

Preferably, the seal bar further comprises an end seal forming portion for forming the end seal portion, wherein a protrusion amount of the end seal forming portion is larger than the protrusion amount of the first region forming portion.

Preferably, the seal bar further comprises first and second sealing units, wherein the vapor release seal forming portion is a first vapor release seal forming portion, the first sealing unit comprises the first vapor release seal forming portion, the second sealing unit comprises a second vapor release seal forming portion for forming the vapor release seal portion, and the first and second vapor release seal forming portions differ from each other in line width.

Preferably, provided is a manufacturing method, comprising: a step of forming the vapor release seal portion by a sealing step including first and second sealing steps, wherein, in the first sealing step, the film is heat-sealed using a first sealing unit having a first vapor release seal forming portion, in the second sealing step, the film is heat-sealed using a second sealing unit having a second vapor release seal forming portion, and the first and second vapor release seal forming portions differ from each other in line width.

BRIEF DESCRIPTION OF DRAWINGS

FIG. 6A is a plan view of the packaging bag 1 of a second embodiment of the present invention.

FIG. 6B is an enlarged view of a region B in FIG. 6A.

DESCRIPTION OF EMBODIMENTS

Hereinafter, embodiments of the present invention will be described. Various characteristics in the embodiments described below can be combined with each other. Further, the invention is independently established for each characteristic.

1. First Embodiment

1-1. Configuration of Packaging Bag 1

Figure 1:
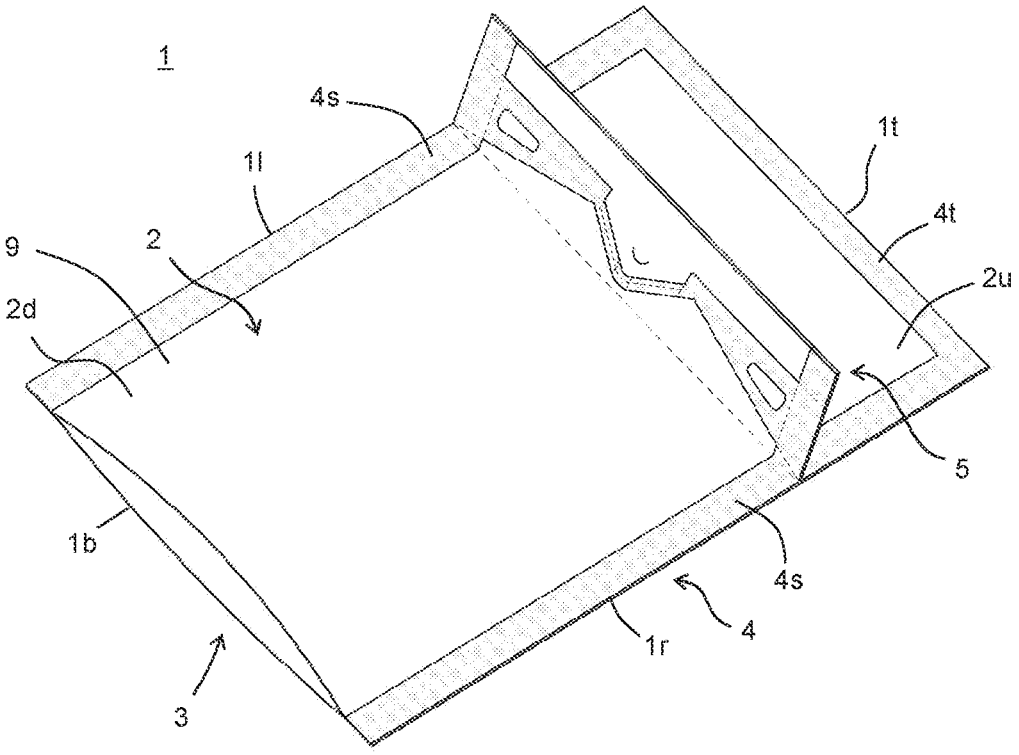
FIG. 1 is a perspective view of a packaging bag 1 of a first embodiment of the present invention.
Figure 2A:
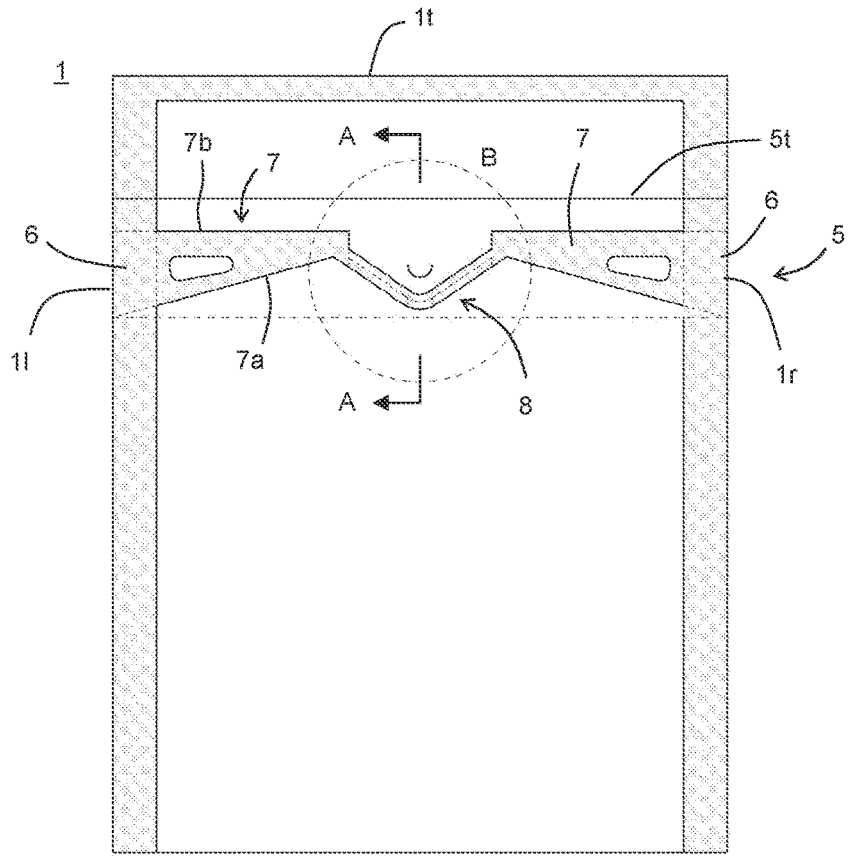
FIG. 2A is a plan view of the packaging bag 1 of the first embodiment of the present invention.
Figure 2B:
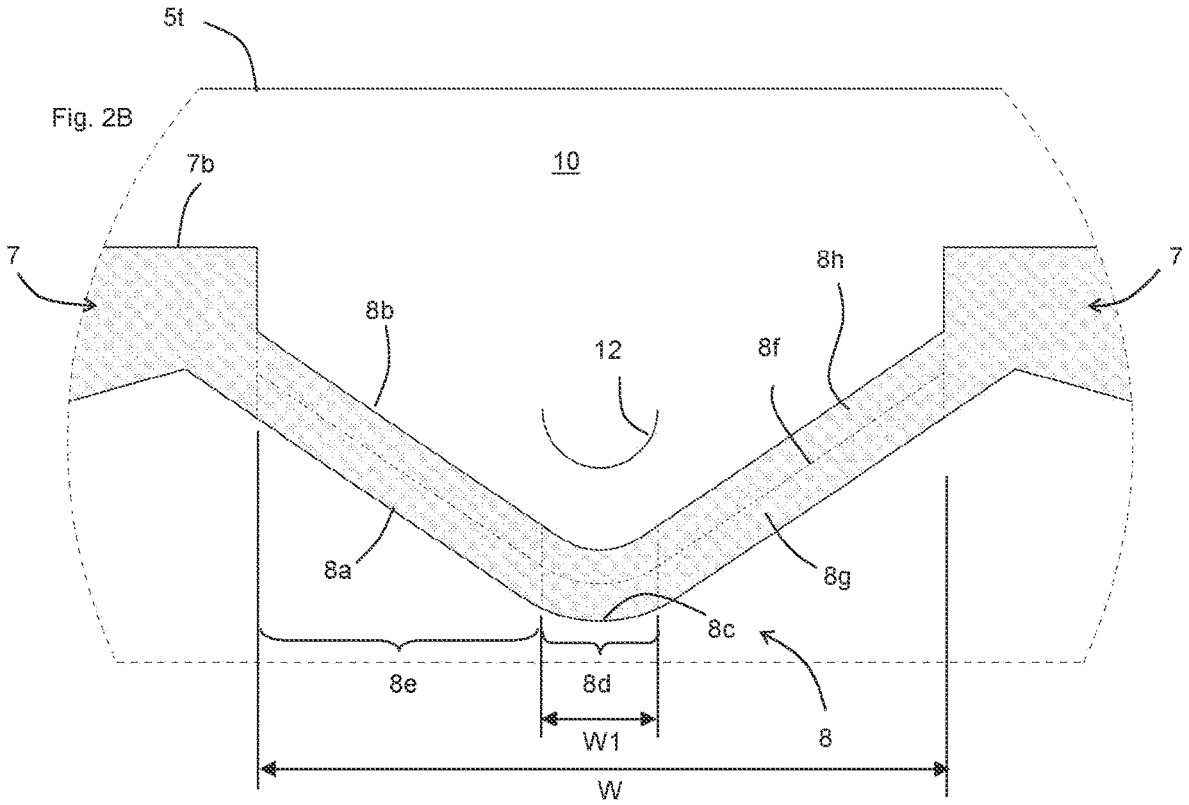
FIG. 2B is an enlarged view of a region B in FIG. 2A.
Figure 3:
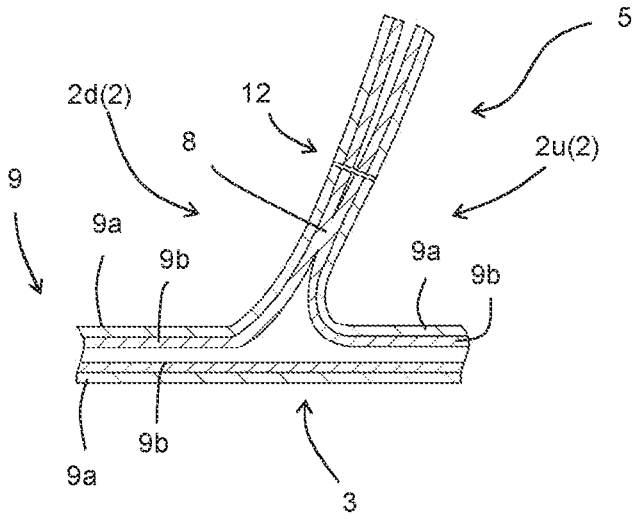
FIG. 3 is a cross-sectional view taken along an A-A line in FIG. 2A.

As shown in FIG. 1 to FIG. 3, a packaging bag 1 of a first embodiment of the present invention is configured by heat-sealing a film 9 at a seal portion 4. The packaging bag 1 includes a front surface portion 2 and a back surface portion 3. The seal portion 4 includes a top seal portion 4*t* formed along an upper edge 1*t* of the packaging bag 1 and a pair of side seal portions 4*s* formed along a right side edge 1*r* or a left side edge 11. Further, the seal portion 4 includes a pair of side seal portions 6, a pair of end seal portions 7, and a vapor release seal portion 8 at a joint portion 5. A lower edge 1*b* of the packaging bag 1 is not heat-sealed before the contents are accommodated and is heat-sealed to form a bottom seal portion after the contents are accommodated in the packaging bag 1. Consequently, the seal portion 4 is provided along the entire circumference of the packaging bag 1, and the inside of the packaging bag 1 is sealed.

As shown in FIG. 3, the film 9 is preferably a laminated film having a base material layer 9*a* and a sealant layer 9*b*, and more preferably, the laminated film includes an adhesive layer and a printing layer between the base material layer 9*a* and the sealant layer 9*b*. The base material layer 9*a* is arranged so as to be exposed on the outer surface of the packaging bag 1, and the sealant layer 9*b* is arranged so as to be exposed on the inner surface of the packaging bag 1. The seal portion 4 is formed by heat-sealing the sealant layers 9*b* to each other.

The base material layer 9*a* is formed of a material having excellent strength and high impact resistance. As the base material layer 9*a*, for example, polyamide, polyolefin, polyethylene, polyester, and the like are used. More specifically, oriented polyethylene terephthalate film, silica-deposited oriented polyethylene terephthalate film, alumina-deposited oriented polyethylene terephthalate film, oriented nylon film, oriented polypropylene film, polypropylene/ethylene-vinyl alcohol copolymer co-extruded co-oriented film, or the like can be used. As a film forming the base material layer 9*a*, a film having straight line cuttability in the MD direction (the direction in which the film flows during manufacturing) is preferably used. The base material layer 9*a*, which is the outermost layer, may contain antibacterial or antiviral agent, such as silver ions. In particular, by kneading a bleed-out antibacterial or antiviral agent into the base material layer 9*a*, the antibacterial or antiviral treatment progresses on the surface of the base material layer 9*a* when it is heated to a high temperature in a microwave oven, which is hygienic and preferable when removing from the microwave oven.

The adhesive layer is a layer for allowing the base material layer 9*a* and the sealant layer 9*b* to adhere to each other so as to be laminated. The adhesion method may be extrusion lamination using, for example, polyethylene as the adhesive layer, or may be dry lamination using polyvinyl acetate adhesive, polyacrylate adhesive, cyanoacrylate adhesive, ethylene copolymer adhesive, cellulose adhesive, polyester adhesive, polyamide adhesive, amino resin adhesive, epoxy adhesive, polyurethane adhesive, and the like as adhesive material.

The sealant layer 9*b* can be formed of resin with excellent heat sealability. The sealant layer 9*b* can be formed with polyolefin-based resins, such as polyethylene, polypropylene, ethylene-vinyl acetate copolymer, and ethylene-propylene block copolymer. More specifically, non-oriented polypropylene and linear low-density polyethylene can be used.

As shown in FIG. 1 to FIG. 3, the front surface portion 2 includes a lower front surface portion 2*d* and an upper front surface portion 2*u*. The lower front surface portion 2*d* and the upper front surface portion 2*u* are each heat-sealed to the back surface portion 3. In the joint portion 5 formed by partially overlapping an inner surface of the lower front surface portion 2*d* and an inner surface of the upper front surface portion 2*u*, the lower front surface portion 2*d* and the upper front surface portion 2*u* are heat-sealed at a pair of side seal portions 6, a pair of end seal portions 7, and the vapor release seal portion 8. The side seal portions 6 are provided at a position along the right side edge 1*r* and the left side edge 11 in the joint portion 5. The end seal portions 7 are provided to connect the side seal portions 6 and the vapor release seal portion 8. Preferably, the end seal portions 7 extend to the right side edge 1*r* or the left side edge 11 and overlap the side seal portions 6. The width of the end seal portion 7 narrows from the side seal portions 6 toward the vapor release seal portion 8. An upper edge 5*t* of the joint portion 5 is parallel to the upper edge 1*t* of the packaging bag 1, and an outer edge 7*b* of the end seal portion 7 is parallel to the upper edge 5*t*. An inner edge 7*a* of the end seal portion 7 gets closer to the outer edge 7*b* toward the vapor release seal portion 8. An unseal portion 10 where films are not heat-sealed to each other is provided between the outer edge 7*b* of the end seal portion 7 and the upper edge 5*t*. The outer edge 7*b* and the upper edge 5*t* may be aligned without providing the unseal portion 10.

The vapor release seal portion 8 is configured to form a vapor flow path as the internal pressure of the packaging bag 1 increases. The vapor release seal portion 8 has a curved shape that is curved toward the inner direction of the packaging bag 1. An inner edge 8*a* of the vapor release seal portion 8 is preferably substantially V-shaped, and an outer edge 8*b* of the vapor release seal portion 8 is also preferably substantially V-shaped. The inner edge 8*a* and the outer edge 8*b* preferably have a portion parallel to each other, and the entire inner edge 8*a* and outer edge 8*b* are preferably parallel to each other. The distance between the inner edge 8*a* and the outer edge 8*b* (that is, the line width of the vapor release seal portion 8) is, for example, 1 to 5 mm, and preferably 2 to 4 mm. This distance is, specifically, for example, 1.0, 1.5, 2.0, 2.5, 3.0, 3.5, 4.0, 4.5, 5.0 mm and may be in a range between any two of the numerical values exemplified herein.

The vapor release seal portion 8 includes a first region 8*d* including a distal end 8*c* of the curved shape and a second region 8*e* adjacent to the first region. The second region 8*e* is a region other than the first region 8*d* in the vapor release seal portion 8. The inner edge 8*a* and the outer edge 8*b* may be parallel to each other in the first region 8*d* and may be parallel to each other in the second region 8*e*. It is preferable to provide the unseal portion 10 between the outer edge 8*b* and the upper edge 5*t*. It is preferable to provide a cut 12 between the outer edge 8*b* and the upper edge 5*t*.

The sealing strength in the first region 8*d* is higher than the sealing strength in the second region 8*e*. Although it is assumed that the peeling in the vapor release seal portion 8 starts from the distal end 8*c*, the peeling at the distal end 8*c* may start at an unintended timing, such as when the packaging bag 1 is subjected to an impact, if the peeling starts too easily at the distal end 8*c*. On the other hand, if the sealing strength of the entire vapor release seal portion 8 is increased to prevent opening at an unintended timing, there arises a problem that peeling does not proceed quickly even if peeling starts at the distal end 8*c*. Therefore, in the present embodiment, the sealing strength in the first region 8*d* is higher than that in the second region 8*e*. In such a configuration, since the sealing strength in the first region 8*d* is relatively high, it is possible to suppress the peeling at the distal end 8*c* from starting at unintended timing. On the other hand, since the sealing strength in the second region 8*e* is relatively low, when peeling starts in the first region 8*d*, the peeling proceeds quickly in the second region 8*e*. Consequently, an opening formed in the vapor release seal portion 8 expands quickly, and thus the formation of an opening in a portion other than the vapor release seal portion is suppressed. In this regard, the sealing strength means sealing strength per unit area unless otherwise specified.

W1/W is preferably 0.05 to 0.5 and more preferably 0.1 to 0.3, where W represents the overall width (the length in the left-right direction) of the vapor release seal portion 8, and W1 represents the width of the first region 8*d*. W1/W is specifically, for example, 0.05, 0.10, 0.15, 0.20, 0.25, 0.30, 0.35, 0.40, 0.45, or 0.50 and may be in a range between any two of the numerical values exemplified herein.

The vapor release seal portion 8 preferably includes an inner region 8*g* and an outer region 8*h* configured by dividing the vapor release seal portion 8 at a boundary line 8*f* located between the inner edge 8*a* and the outer edge 8*b* of the vapor release seal portion 8. Preferably, the inner region 8*g* and the outer region 8*h* differ from each other in sealing strength. Preferably, the sealing strength in the inner region 8*g* is higher than the sealing strength in the outer region 8*h*. By increasing the sealing strength of a part of the vapor release seal portion 8 along the line width direction, it is possible to prevent the peeling of the vapor release seal portion 8 at an unintended timing. The boundary line 8*f* is preferably parallel to at least one of the inner edge 8*a* and the outer edge 8*b*. The ratio of the line width of the inner region 8*g* to the overall line width of the vapor release seal portion 8 is, for example, 0.1 to 0.9 and preferably 0.2 to 0.8. This ratio is, specifically, for example, 0.1, 0.2, 0.3, 0.4, 0.5, 0.6, 0.7, 0.8, or 0.9 and may be in a range between any two of the numerical values exemplified herein. In the present embodiment, the ratio of the line width of the inner region 8*g* is 0.5.

1-2. Usage of Packaging Bag 1

After the packaging bag 1 is filled with the contents, a bottom seal portion is formed at a lower edge of the packaging bag 1. Consequently, the inside of the packaging bag 1 is sealed.

When the packaging bag 1 filled with the contents is heated in a microwave oven, the internal pressure of the packaging bag 1 increases due to vapor generated from the moisture contained in the contents. Consequently, when the peeling starts in the first region 8*d* including the curved distal end 8*c* of the vapor release seal portion 8, the peeling proceeds quickly in the second region 8*e*. Consequently, the vapor flow path formed in the vapor release seal portion 8 expands quickly, and the vapor is quickly released to the outside. The vapor is released to the outside from the upper edge 5*t* of the joint portion 5 and from the cut 12.

1-3. Manufacturing Method of Packaging Bag 1

Figure 4:
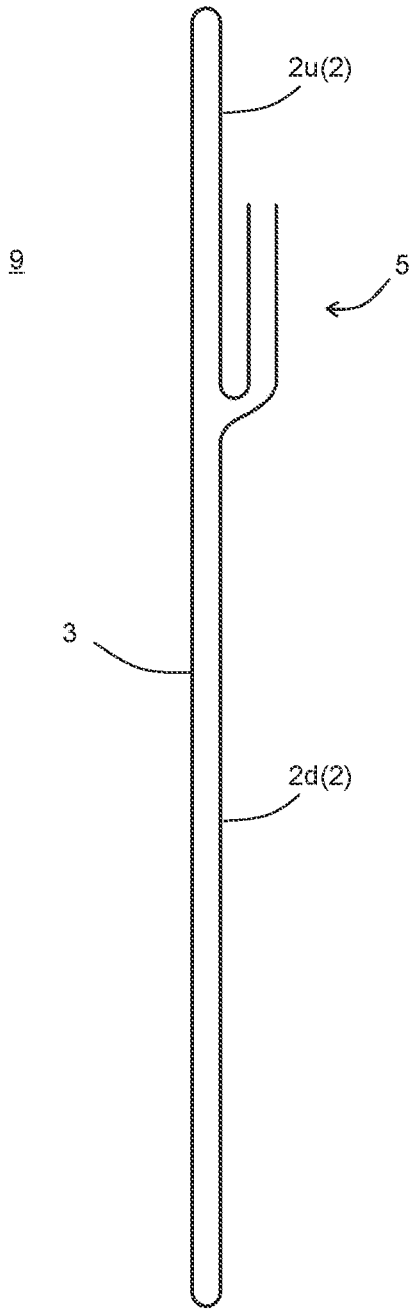
FIG. 4 is a side view of the film 9 folded such that the packaging bag 1 can be manufactured by heat-sealing.
Figure 5A:
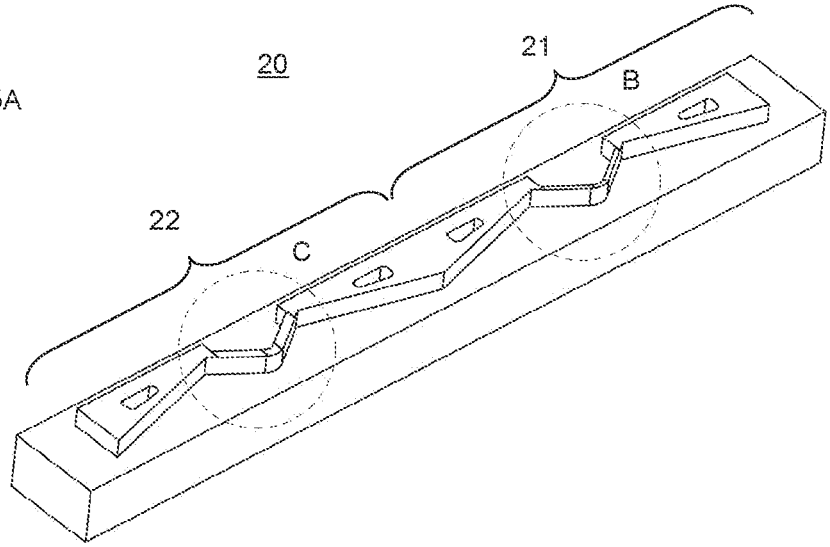
FIG. 5A is a perspective view of a seal bar 20 of the first embodiment of the present invention.
Figure 5C:
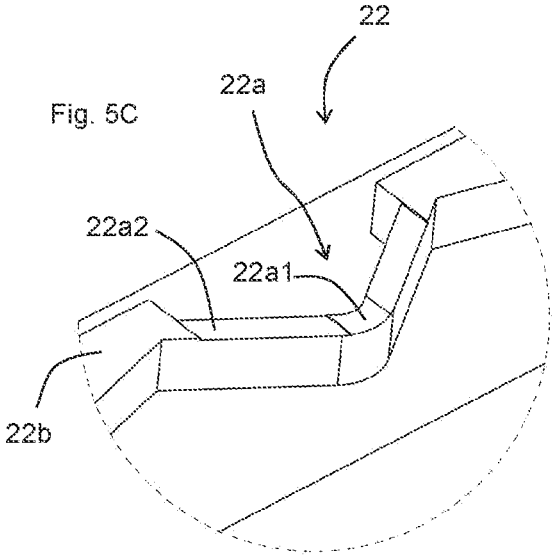
FIG. 5C is an enlarged view of a region C in FIG. 5A.
Figure 5B:
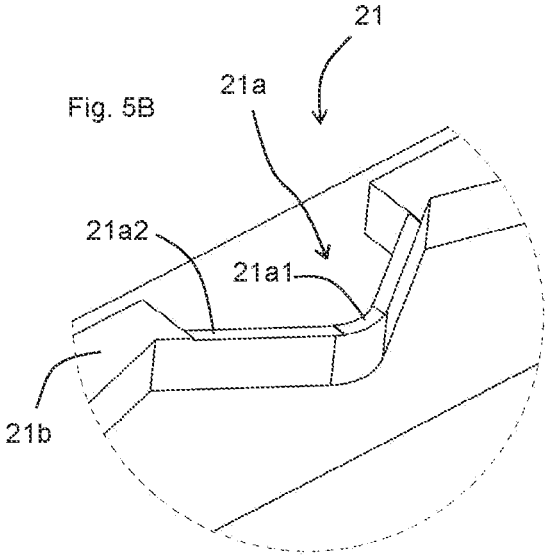
FIG. 5B is an enlarged view of a region B in FIG. 5A.

The packaging bag 1 can be formed by forming the seal portion 4 on the film 9. In one example, the seal portion 4 can be formed by heat-sealing the film 9 folded into the shape shown in FIG. 4. The film 9 in the state shown in FIG. 4 includes the front surface portion 2 and the back surface portion 3, and the front surface portion 2 and the back surface portion 3 are connected to each other at the upper edge and the lower edge. The front surface portion 2 and the back surface portion 3 may be separated at one or both of the upper edge and the lower edge. The front surface portion 2 includes the lower front surface portion 2*d* and the upper front surface portion 2*u*, and the joint portion 5 is formed by partially overlapping the inner surface of the lower front surface portion 2*d* and the inner surface of the upper front surface portion 2*u*. In one example, after forming a pair of end seal portions 7 and the vapor release seal portion 8 in the joint portion 5, the top seal portion 4*t*, the side seal portion 4*s*, and the side seal portion 6 are formed to obtain the packaging bag 1 with the configuration shown in FIG. 1. The end seal portion 7 and the vapor release seal portion 8 can be formed using a seal bar 20 shown in FIG. 5A to FIG. 5C.

The seal bar 20 includes first and second sealing units 21, 22. The first sealing unit 21 includes a vapor release seal forming portion 21*a* for forming the vapor release seal portion 8 and an end seal forming portion 21*b* for forming the end seal portion 7. The vapor release seal forming portion 21*a* includes a first region forming portion 21*a*1 for forming the first region 8*d* and a second region forming portion 21*a*2 for forming the second region 8*e*. The protrusion amount of the first region forming portion 21*a*1 is larger than the protrusion amount of the second region forming portion 21*a*2. The protrusion amount of the end seal forming portion 21*b* is larger than the protrusion amount of the first region forming portion 21*a*1. That is, the protrusion amount is set such that the second region forming portion 21*a*2<the first region forming portion 21*a*1<the end seal forming portion 21*b*. During heat-sealing, the portion with a larger protrusion amount is pressed more strongly against the film 9 to increase the sealing strength of the film 9. Therefore, when the end seal portion 7 and the vapor release seal portion 8 are formed using the seal bar 20 of the above-described configuration, the sealing strength can be such that the second region 8*e*<the first region 8*d*<the end seal portion 7.

The difference in the protrusion amount between the second region forming portion 21*a*2 and the first region forming portion 21*a*1 is, for example, 1 to 100 μm, preferably 5 to 30 μm, specifically, for example, 1, 5, 10, 20, 30, 40, 50, 60, 70, 80, 90, or 100 μm and may be in a range between any two of the numerical values exemplified herein. The same applies to the difference in the protrusion amount between the first region forming portion 21*a*1 and the end seal forming portion 21*b*.

The second sealing unit 22 has the same basic configuration as the first sealing unit 21, and reference signs of various portions of the second sealing unit 22 correspond to the reference signs of the portions of the first sealing unit 21 changed from "21" to "22". The first and second sealing units 21, 22 are connected to each other at the end seal forming portions 21*b*, 22*b*.

The vapor release seal forming portions 21*a*, 22*a* of the first and second sealing units 21, 22 differ from each other in the distance between the inner edge and the outer edge of the vapor release seal forming portions 21*a*, 22*a* (that is, the line width of the vapor release seal forming portion). The value of (line width of the vapor release seal forming portion having a larger line width)/(line width of the vapor release seal forming portion having a smaller line width) is, for example, 1.1 to 5 and preferably 1.5 to 3. This value is specifically, for example, 1.1, 1.5, 2.0, 2.5, 3.0, 3.5, 4.0, 4.5, or 5.0 and may be in a range between any two of the numerical values exemplified herein. In the present embodiment, the above-described value is 2. In the present embodiment, in FIG. 5A to FIG. 5C, the line width of the vapor release seal forming portion 21*a* is smaller than the line width of the vapor release seal forming portion 22*a*, but the line width of the vapor release seal forming portion 22*a* may be smaller than the line width of the vapor release seal forming portion 21*a*.

The vapor release seal portion 8 can be formed by a sealing step including first and second sealing steps. In the first sealing step, the film 9 is heat-sealed using the first sealing unit 21 having the first vapor release seal forming portion 21*a*, and in the second sealing step, the film 9 is heat-sealed using the second sealing unit 22 having the second vapor release seal forming portion 22*a*.

In one example, the film 9 is moved after performing the first sealing step to move the end seal portion 7 and the vapor release seal portion 8 formed in the first sealing step to a position facing the second sealing unit 22, and then the second sealing step can be formed. The first and second sealing units 21, 22 are adjacent to each other in the seal bar 20. Therefore, when the second sealing step is performed on a first packaging bag 1, the first sealing step can be performed on a second packaging bag 1 on an upstream side. Therefore, when a large number of packaging bags 1 are sequentially manufactured, the manufacturing time per bag can be reduced.

Since the vapor release seal forming portions 21*a*, 22*a* differ from each other in line width, they also differ from each other in sealing width on the film 9. By forming the vapor release seal portion 8 by such a step, the sealing strength of the inner region 8*g* and the outer region 8*h* can be different from each other. In one example, only the inner region 8*g* is heat-sealed in the first sealing step, and both the inner region 8*g* and the outer region 8*h* are heat-sealed in the second sealing step. Consequently, the sealing strength of the inner region 8*g* can be higher than the sealing strength of the outer region 8*h*.

In this regard, although the case where one seal bar 20 includes the first and second sealing units 21, 22 is taken as an example, the first and second sealing units 21, 22 may be provided on separate seal bars.

2. Second Embodiment

A second embodiment of the present invention will be described with reference to FIG. 6A to FIG. 7C. The present embodiment is similar to the first embodiment, and the following description mainly focuses on the differences.

2-1. Configuration of Packaging Bag 1

In the packaging bag 1 of the first embodiment, depending on the resin composition of the sealant layer, the sealing strength in the first region 8*d* may become too high, resulting in slow vapor release, which may cause loud noise when the vapor release seal portion 8 is opened. For example, when the sealant layer is made of LLDPE, the sealing strength in the first region 8*d* is likely to be too high compared to when the sealant layer is made of non-oriented polypropylene.

To reduce the sealing strength in the first region 8*d*, the pressure at which the seal bar 20 is pressed can be reduced. However, since the fine adjustment of the pressure at which the seal bar 20 is pressed is not easy, the variation in the sealing strength from product to product tends to increase as a result of reducing the pressure at which the seal bar 20 is pressed.

In the present embodiment, to solve such a problem, a protruding portion 8*d*2 is provided in the first region 8*d* to improve the peelability in the first region 8*d*. Consequently, regardless of the resin composition of the sealant layer, it is possible to suppress the generation of a loud noise when the vapor release seal portion 8 is opened.

Specifically, in the present embodiment, the first region 8*d* includes a base portion 8*d*1 and the protruding portion 8*d*2, as shown in FIG. 6A and FIG. 6B. The protruding portion 8*d*2 protrudes from the base portion 8*d*1 toward an inner side of the packaging bag 1. The inner edge 8*a* of the base portion 8*d*1 is provided with a step portion 8*i*. The angle of the step portion 8*i* (hereinafter, referred to as "inclination angle") with respect to a direction perpendicular to a lower edge (base) 5*b* of the joint portion 5 (up-down direction in FIG. 6B) is larger than that of the second region 8*e* and the protruding portion 8*d*2. In the present embodiment, the above-described inclination angle is 90 degrees. By providing the step portion 8*i*, a step is formed between the second region 8*e* and the protruding portion 8*d*2. Consequently, the width of the protruding portion 8*d*2 at a lower end 8*j* of the protruding portion 8*d*2 becomes narrower, and the protruding portion 8*d*2 has an inverted triangular shape. The inclination angle of the portion where the inclination angle of the inner edge 8*a* of the protruding portion 8*d*2 is the largest is the same as or smaller than the inclination angle of the portion where the inclination angle of the inner edge 8*a* of the second region 8*e* is the largest. Consequently, the protruding portion 8*d*2 protrudes steeply, and the pressure is more likely to be concentrated at the distal end of the protruding portion 8*d*2.

The distal end of the protruding portion 8*d*2 is provided with a weak seal region 8*d*3. The weak seal region 8*d*3 is a portion where the sealing strength is weaker than that of the protruding portion 8*d*2. By providing the weak seal region 8*d*3, the peeling at the protruding portion 8*d*2 is more easily started.

Further, in the present embodiment, the ratio of the line width of the inner region 8*g* to the overall line width of the vapor release seal portion 8 is about 0.8. Consequently, the peeling in the second region 8*e* at an unintended timing is suppressed more effectively.

2-2. Manufacturing Method of Packaging Bag 1

Figure 7A:
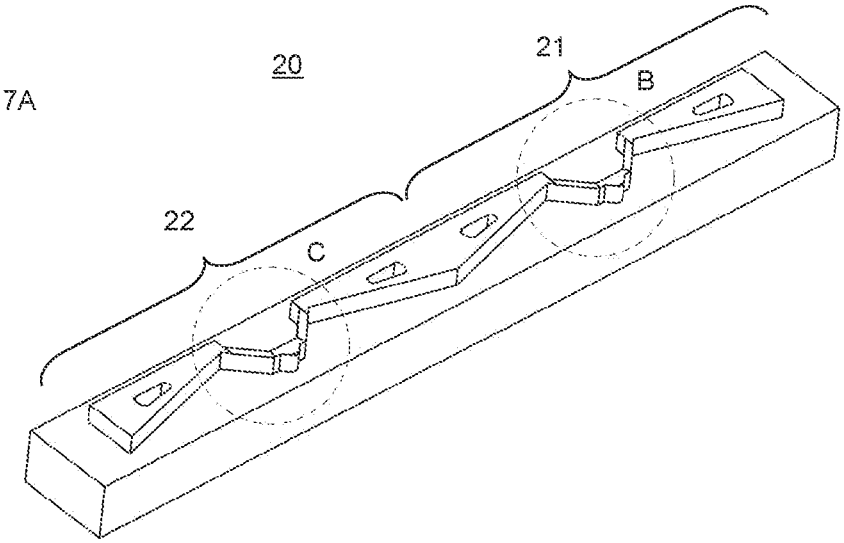
FIG. 7A is a perspective view of the seal bar 20 of the second embodiment of the present invention.
Figure 7C:
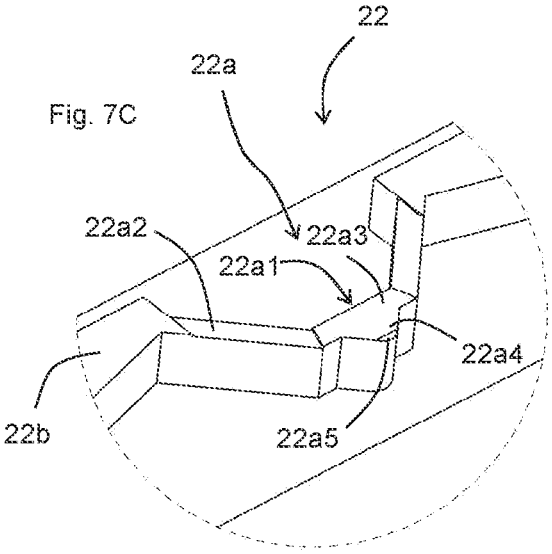
FIG. 7C is an enlarged view of a region C in FIG. 7A.
Figure 7B:
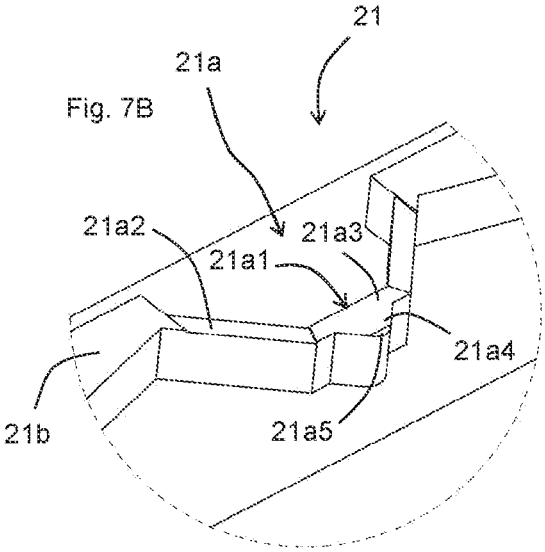
FIG. 7B is an enlarged view of a region B in FIG. 7A.

In the present embodiment, using the seal bar 20 shown in FIG. 7A to FIG. 7C, the end seal portion 7 and the vapor release seal portion 8 are formed.

In the first sealing unit 21 of the seal bar 20 of the present embodiment, the first region forming portion 21*a*1 for forming the first region 8*d* includes a base portion 21*a*3 and a protruding portion 21*a*4. The distal end of the protruding portion 21*a*4 is provided with a chamfered portion 21*a*5. The chamfered portion 21*a*5 is configured by chamfering the distal end of the protruding portion 21*a*4. This chamfer may be an R chamfer or a C chamfer. By providing the chamfered portion 21*a*5, the protruding portion 21*a*4 is prevented from damaging the film. The base portion 21*a*3, the protruding portion 21*a*4, and the chamfered portion 21*a*5 form the base portion 8*d*1 of the first region 8*d*, the protruding portion 8*d*2, and the weak seal region 8*d*3, respectively. The second sealing unit 22 is similarly configured, and reference signs of various portions of the second sealing unit 22 correspond to the reference signs of the portions of the first sealing unit 21 changed from "21" to "22".

Further, in the present embodiment, the vapor release seal forming portions 21*a*, 22*a* differ from each other in the distance between the inner edge and the outer edge of the vapor release seal forming portions 21*a*, 22*a* (that is, the line width of the vapor release seal forming portion). The value of (line width of the vapor release seal forming portion having the larger line width)/(line width of the vapor release seal forming portion having the smaller line width) is 1.25.

Further, in the present embodiment, the end seal forming portion 21*b* and the first region forming portion 21*a*1 have the same amount of protrusion, and they have a larger amount of protrusion than the second region forming portion 21*a*2. Therefore, when the seal bar 20 of the present embodiment is used to form the end seal portion 7 and the vapor release seal portion 8, the sealing strength becomes such that the second region 8*e*<the first region 8*d*=the end seal portion 7.

EXAMPLES

Example 1

The packaging bag 1 with the vapor release seal portion 8 having the same shape as in the first embodiment was prepared using the film 9 in which a polyamide layer with a thickness of 15 μm and a non-oriented polypropylene with a thickness of 60 μm were laminated. The packaging bag 1 was filled with water.

When the packaging bag 1 was heated in a microwave oven to test whether the vapor release seal portion 8 functions properly (vapor discharge test), it was confirmed that vapor was discharged from the vapor release seal portion 8 without loud noise.

Example 2

The packaging bag 1 was manufactured in the same manner as in Example 1 except that the non-oriented polypropylene layer was changed to an LLDPE layer. When the vapor discharge test was performed, there was a case where a loud noise was generated when the vapor release seal portion 8 is opened.

Example 3

The packaging bag 1 was manufactured in the same manner as in Example 2 except that the shape of the vapor release seal portion 8 was changed to that of the second embodiment. When the vapor discharge test was performed, it was confirmed that vapor was discharged from the vapor release seal portion 8 without loud noise.

REFERENCE SIGNS LIST

1: packaging bag, 1*b*: lower edge, 11: left side edge, 1*r*: right side edge, 1*t*: upper edge, 2: front surface portion, 2*d*: lower front surface portion, 2*u*: upper front surface portion, 3: back surface portion, 4: seal portion, 4*s*: side seal portion, 4*t*: top seal portion, 5: joint portion, 5*b*: lower edge (base), 5*t*: upper edge, 6: side seal portion, 7: end seal portion, 7*a*: inner edge, 7*b*: outer edge, 8: vapor release seal portion, 8*a*: inner edge, 8*b*: outer edge, 8*c*: distal end, 8*d*: first region, 8*d*1: base portion, 8*d*2: protruding portion, 8*d*3: weak seal region, 8*e*: second region, 8*f*: boundary line, 8*g*: inner region, 8*h*: outer region, 8*i*: step portion, 8*j*: lower end, 9: film, 9*a*: base material layer, 9*b*: sealant layer, 10: unseal portion, 12: cut, 20: seal bar, 21: first sealing unit, 21*a*: first vapor release seal forming portion, 21*a*1: first region forming portion, 21*a*2: second region forming portion, 21*a*3: base portion, 21*a*4: protruding portion, 21*a*5: chamfered portion, 21*b*: end seal forming portion, 22: second sealing unit, 22*a*: second vapor release seal forming portion, 22*a*1: first region forming portion, 22*a*2: second region forming portion, 22*a*3: base portion, 22*a*4: protruding portion, 22*a*5: chamfered portion, 22*b*: end seal forming portion

The invention claimed is:

1. A packaging bag made of a film heat-sealed at a seal portion, wherein the seal portion comprises a vapor release seal portion configured to form a vapor flow path as an internal pressure increases, the vapor release seal portion has a curved shape curved toward an inner direction of the packaging bag, the vapor release seal portion includes a first region including a distal end of the curved shape and a second region adjacent to the first region, and a sealing strength in the first region is higher than a sealing strength in the second region, wherein the vapor release seal portion comprises an inner region and an outer region configured by dividing the vapor release seal portion at a boundary line located between an inner edge and an outer edge of the vapor release seal portion, and a sealing strength in the inner region is higher than a sealing strength in the outer region; and wherein the inner region is toward the inner direction of the packaging bag.

2. The packaging bag of claim 1, wherein the packaging bag comprises a front surface portion having a lower front surface portion and an upper front surface portion, at a joint portion where an inner surface of the lower front surface portion and an inner surface of the upper front surface portion are partially overlapped, the lower front surface portion and the upper front surface portion are heat-sealed at a pair of side seal portions, a pair of end seal portions, and the vapor release seal portion, the side seal portions are provided along side edges of the joint portion and are connected to the vapor release seal portion via the end seal portions, and sealing strength at the end seal portions is higher than the sealing strength in the first region.

3. A seal bar used for manufacturing the packaging bag of claim 1, comprising:

a vapor release seal forming portion for forming the vapor release seal portion, wherein the vapor release seal forming portion comprises a first region forming portion for forming the first region and a second region forming portion for forming the second region, and a protrusion amount of the first region forming portion is larger than a protrusion amount of the second region forming portion.

4. The seal bar of claim 3, wherein the packaging bag comprises a front surface portion having a lower front surface portion and an upper front surface portion, at a joint portion where an inner surface of the lower front surface portion and an inner surface of the upper front surface portion are partially overlapped, the lower front surface portion and the upper front surface portion are heat-sealed at a pair of side seal portions, a pair of end seal portions, and the vapor release seal portion, the side seal portions are provided along side edges of the joint portion and are connected to the vapor release seal portion via the end seal portions, sealing strength at the end seal portions is higher than the sealing strength in the first region, the seal bar further comprises an end seal forming portion for forming the end seal portion, and a protrusion amount of the end seal forming portion is larger than the protrusion amount of the first region forming portion.

5. The seal bar of claim 3, further comprising:

first and second sealing units, wherein the vapor release seal forming portion is a first vapor release seal forming portion, the first sealing unit comprises the first vapor release seal forming portion, the second sealing unit comprises a second vapor release seal forming portion for forming the vapor release seal portion, and the first and second vapor release seal forming portions differ from each other in line width.

6. A packaging bag made of a film heat-sealed at a seal portion, wherein the seal portion comprises a vapor release seal portion configured to form a vapor flow path as an internal pressure increases, the vapor release seal portion has a curved shape curved toward an inner direction of the packaging bag, the vapor release seal portion includes a first region including a distal end of the curved shape and a second region adjacent to the first region, a sealing strength in the first region is higher than a sealing strength in the second region, the first region includes a base portion and a protruding portion, the protruding portion protrudes from the base portion toward the inner direction of the packaging bag, a step portion is provided on an inner edge of the base portion so that the step portion provides a step between the second region and the protruding portion, a weakly sealed region is provided at a tip of the protruding portion, and the seal strength of the weakly sealed region is weaker than that of other regions of the protruding portion.

* * * * *